US010349702B2

(12) United States Patent
McFarland, II et al.

(10) Patent No.: US 10,349,702 B2
(45) Date of Patent: Jul. 16, 2019

(54) KNITTING OF MULTIPLE UPPERS ON A MACHINE

(71) Applicant: NIKE, Inc., Beaverton, OR (US)

(72) Inventors: William C. McFarland, II, Portland, OR (US); Kristen Orme, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 245 days.

(21) Appl. No.: 15/260,697

(22) Filed: Sep. 9, 2016

(65) Prior Publication Data

US 2018/0070678 A1 Mar. 15, 2018

(51) Int. Cl.

| | |
|---|---|
| ***A43B 1/04*** | (2006.01) |
| ***D04B 1/22*** | (2006.01) |
| ***A43B 23/02*** | (2006.01) |
| ***A43B 23/04*** | (2006.01) |
| ***D03D 11/02*** | (2006.01) |
| ***D03D 15/00*** | (2006.01) |

(52) U.S. Cl.

CPC ..... *A43B 23/0295* (2013.01); *A43B 1/04* (2013.01); *A43B 23/0255* (2013.01); *A43B 23/042* (2013.01); *A43B 23/045* (2013.01); *D03D 11/02* (2013.01); *D03D 15/0033* (2013.01); *D04B 1/22* (2013.01); *D10B 2403/032* (2013.01); *D10B 2501/043* (2013.01)

(58) Field of Classification Search

CPC ... A43B 23/0295; A43B 1/04; A43B 23/0255; A43B 23/042; A43B 23/045; D03D 11/02; D03D 15/0033; D04B 1/22; D04B 1/26; D04B 7/30; D10B 2403/032; D10B 2501/043

USPC ..... 36/45; 66/177, 178 R

See application file for complete search history.

(56) References Cited

U.S. PATENT DOCUMENTS

| | | | |
|---|---|---|---|
| 3,068,816 | A | 12/1962 | McBean |
| 3,446,036 | A | 5/1969 | Doughty |
| 4,073,246 | A | 2/1978 | Crawford et al. |
| 5,345,638 | A | 9/1994 | Nishida et al. |
| 5,345,889 | A | 9/1994 | Gazzarrini et al. |
| 5,385,036 | A | 1/1995 | Spillane et al. |
| 6,986,269 | B2 | 1/2006 | Dua |

(Continued)

FOREIGN PATENT DOCUMENTS

| | | |
|---|---|---|
| EP | 0 470 789 A2 | 2/1992 |
| GB | 1381375 | 1/1975 |

(Continued)

OTHER PUBLICATIONS

International Search Report and Written Opinion in corresponding International Application No. PCT/US2017/050443, dated Jan. 3, 2018, 16 pages.

(Continued)

*Primary Examiner* — Danny Worrell

*Assistant Examiner* — F Griffin Hall

(74) *Attorney, Agent, or Firm* — Brinks Gilson & Lione

(57) ABSTRACT

Methods for manufacturing articles of footwear including forming a first upper on a textile manufacturing machine and forming a second upper on the textile manufacturing machine at a time that at least partially overlaps with formation of the first upper. The first upper and the second upper are formed at separate locations of the textile manufacturing machine.

14 Claims, 8 Drawing Sheets

(56) References Cited

U.S. PATENT DOCUMENTS

| | | | | |
|---|---|---|---|---|
| 8,490,299 | B2 | 7/2013 | Dua et al. | |
| 8,757,038 | B2 | 6/2014 | Siegismund | |
| 8,839,824 | B2 | 9/2014 | Cross et al. | |
| 2008/0110048 | A1* | 5/2008 | Dua | A43B 1/04 36/45 |
| 2012/0255201 | A1 | 10/2012 | Little | |
| 2014/0237854 | A1 | 8/2014 | Fallon | |
| 2014/0338222 | A1 | 11/2014 | Song | |

FOREIGN PATENT DOCUMENTS

| | | | | | |
|---|---|---|---|---|---|
| GB | 2 180 266 | A | | 3/1987 | |
| GB | 2180266 | A | * | 3/1987 | D04B 7/00 |
| WO | WO 2005/092134 | A1 | | 10/2005 | |
| WO | WO 2016/032769 | A2 | | 3/2016 | |

OTHER PUBLICATIONS

Office Action and English translation for corresponding Taiwan Application No. 106130837, dated Dec. 4, 2018, 25 pages.
Office Action and English translation of corresponding Taiwan Application No. 106130837, dated Dec. 4, 2018, 25 pages.
International Preliminary Report on Patentability for corresponding PCT Application No. PCT/US2017/050443, dated Mar. 12, 2019, 9 pages.

* cited by examiner

KNITTING OF MULTIPLE UPPERS ON A MACHINE

BACKGROUND

1. Technical Field Text

The present invention relates to articles of footwear and methods of manufacturing articles of footwear on a textile manufacturing machine. The invention concerns, more particularly, methods of knitting two uppers on a textile manufacturing machine to form multiple uppers, such as a pair of shoes.

2. Background Information

Textile manufacturing machines are used to perform processes including, without limitation, weaving, knitting, crocheting, knotting, and felting to create textiles that may be made of one or more types of yarn and other material or components. These manufactured textiles may make a variety of articles, such as clothing, footwear, and other goods.

Articles of footwear generally include an upper or an upper and a sole structure. The upper may be attached or secured to the sole structure, and the sole structure may provide support and comfort for a foot of the wearer, while also providing a structure between the ground and the wearer's foot. A variety of materials and other components may be used to make the sole structure to provide support and comfort. The upper of the article of footwear generally surrounds the foot of the wearer and may extend over the top or instep area of the foot, toe area of the foot, along the lateral and medial sides of the foot, around the back or ankle/heel area of the foot, and under the foot. A variety of materials, components and/or one or more layers of the same may be used to make the upper to provide comfort, support, flexibility, wear-resistance, air-permeability, compressibility, stretch-resistance, moisture-wicking, and other features.

An example of a textile manufacturing machine is a knitting machine. Knitting machines may be used to create a knitted textile to form an upper of an article of footwear. Different types of knitting machines include, without limitation, flat knitting machines, such as V-bed flat knitting machines, and circular knitting machines.

Knitting machines regularly knit one upper at a time. However, on certain machines such as a flat knitting machine, it may take a significant time, for example, at least 25 minutes, to knit a single upper depending on its complexity and the structures of the upper involved. For example, the knitting machine will knit the upper for the left shoe of a wearer, and once the left upper is completed, the knitting machine will knit the upper for the right shoe of a wearer, or vice versa. During this process, each upper is knitted along its length, which regularly requires the carriage and needles of the knitting machine to travel along the needle bed the length of the upper to produce one course of the upper, and then travel back the same distance to begin knitting a subsequent course of the upper. This potentially significant time to manufacture each upper may lead to inefficiencies in production of making a pair of uppers for a wearer including slower production time and higher effort and expense in machine usage.

BRIEF SUMMARY

In one aspect, the present invention relates to a method for manufacturing articles of footwear including forming a first upper on a textile manufacturing machine and forming a second upper on the textile manufacturing machine at a time that at least partially overlaps with formation of the first upper. The first upper and the second upper are formed at separate locations of the textile manufacturing machine.

In another aspect, the present invention relates to an upper for an article of footwear including a pre-folded shape after initial formation on a textile manufacturing machine and a folded shape that defines a final shape of the upper. The pre-folded shape includes a length along a direction of manufacture on the textile manufacturing machine, and a width generally traverse to the length. The upper includes first and second ends along the length of the upper in the pre-folded shape. The first end includes a toe region, and a central region disposed between the first and second ends includes a heel region.

In another aspect, the present invention relates to a method for manufacturing articles of footwear including forming a first upper on a textile manufacturing machine and forming a second upper on the textile manufacturing machine at a time that at least partially overlaps with formation of the first upper. The first upper is formed on the textile manufacturing machine in a configuration having a length and a width. The length being at least two times greater than the width.

The accompany drawings, which are incorporated herein and constitute part of this specification, and, together with the general description given above and the detailed description given below, serve to explain features of the present invention.

DETAILED DESCRIPTION OF THE DRAWINGS AND THE PRESENTLY PREFERRED EMBODIMENTS

Figure 1:
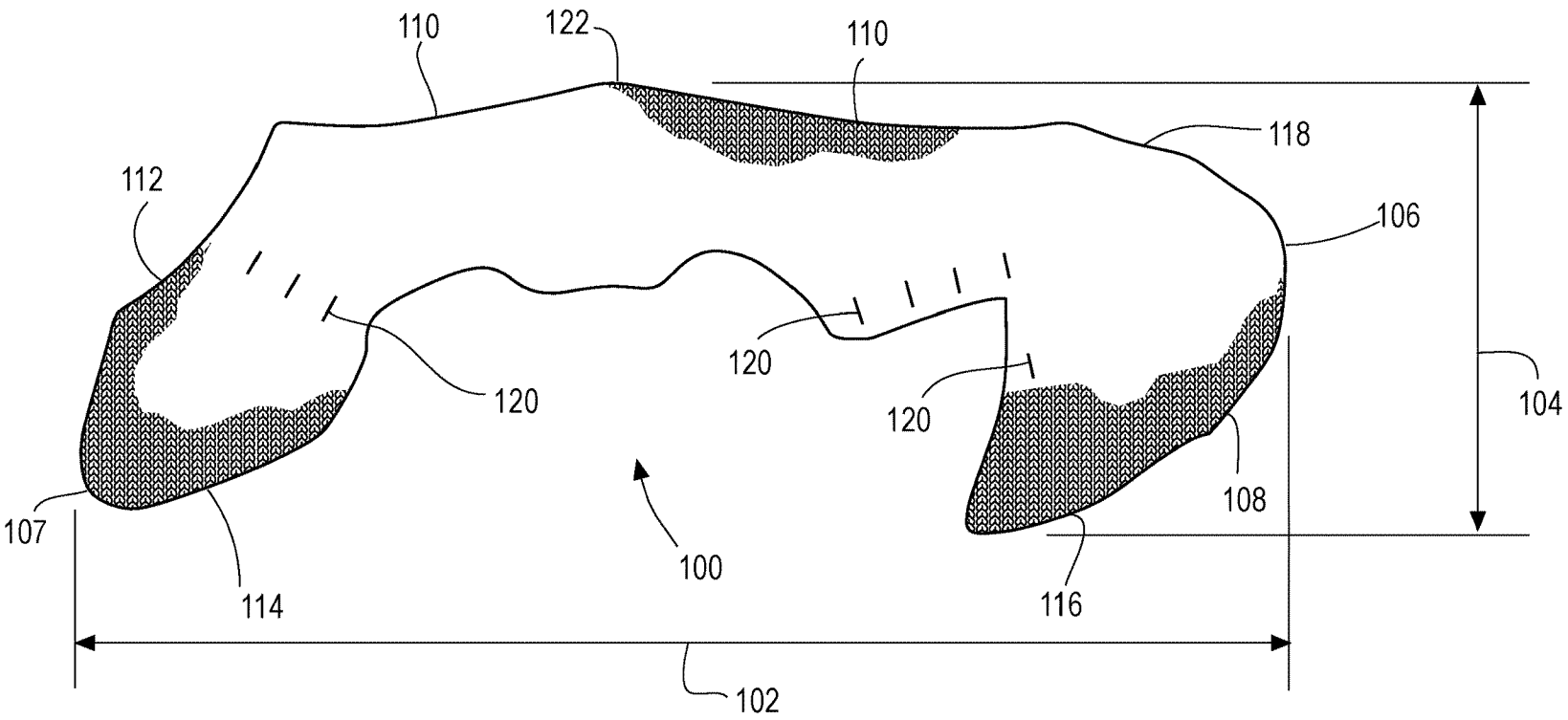
FIG. 1 shows a top view of an embodiment of an upper in a pre-folded shape.

FIG. 1 shows an embodiment of an upper 100 for an article of footwear in a pre-folded or two-dimensional (2D) shape. The upper 100 shown in FIG. 1 may be a left upper, in other words, an upper configured for a left foot of a wearer, or a right upper, which is an upper configured for a right foot of a wearer, for a pair of shoes. FIG. 1 will be described as showing a left upper and such description is for aiding discussion and it is contemplated that the upper 100 shown in FIG. 1 may also be configured for a right upper. The right upper may be symmetrical to the left upper except it is flipped along its width.

The upper 100 includes a length 102 and a width 104. The length 102 of the upper 100 extends from a first end 106 to a second end 107 of the upper 100. The width 104 of the upper 100 is the maximum width of the upper 100 along its length 102. In various embodiments of the present disclosure, the length 102 of the upper 100 is at least two times greater than the width 104 of the upper 100.

The pre-folded upper 100 also includes a toe region 108, a central region 110, a tongue 112, and a gusset 114. The toe region 108 extends from the first end 106 of the upper 100 for a length along a medial side 116 of the toe region 108 and for a length along a lateral side 118 of the toe region 108. The dimensions of the upper 100 and each respective side and/or region of the upper 100 will vary depending on the size of the foot of the intended wearer for the upper 100.

Figure 10:
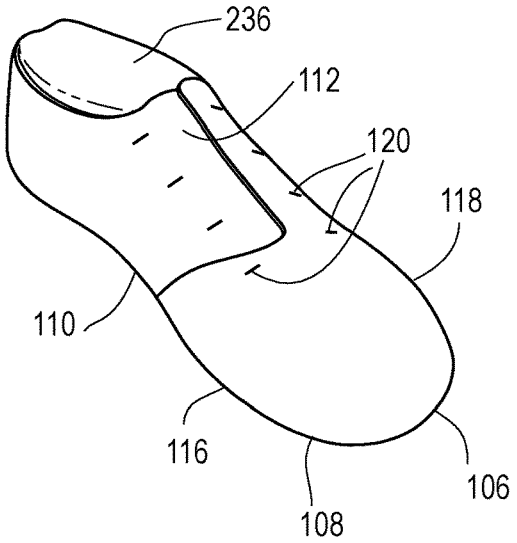
FIG. 10 shows a perspective view of the upper of FIG. 1 in a folded shape.
Figure 11:
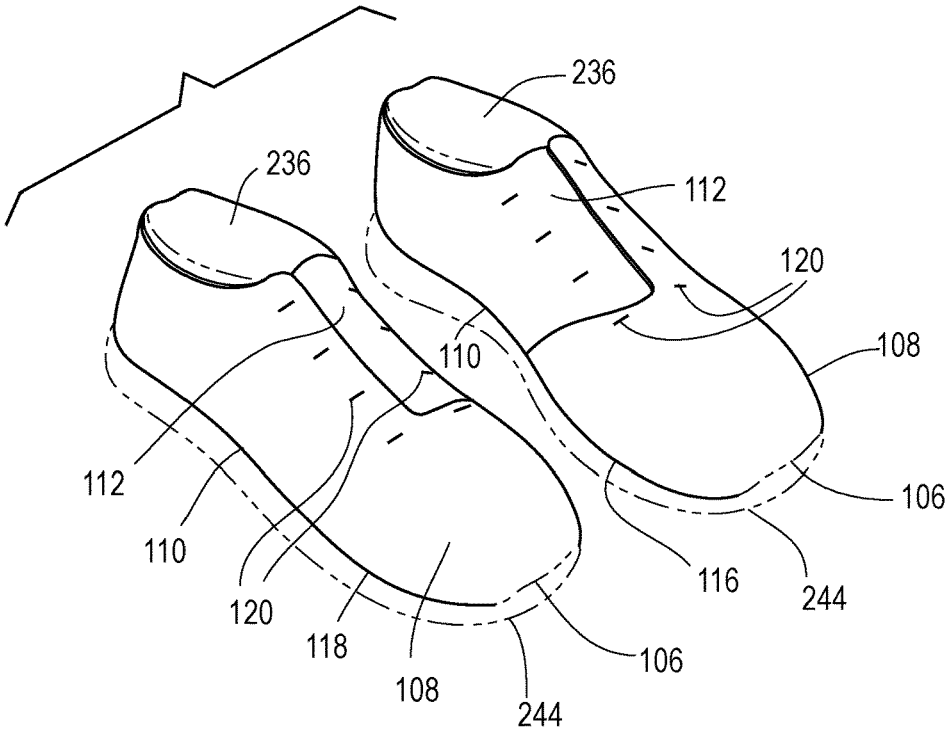
FIG. 11 shows a perspective view of a pair of the folded uppers of FIG. 1.

The central region 110 of the upper 100 extends from the toe region 108 for a portion of the length 102 of the upper 100. The central region 110 includes a heel region 122 that, when folded, is configured to extend around the heel of a wearer. When the upper 100 is folded, as shown in FIGS. 10-11, a portion of the central region 110 of the upper 100 will extend along a lateral side of the upper 100 and a portion of the central region 110 will also extend along a medial side of the upper 100. The central region 110 and/or the toe region 108 may include a plurality of slits or holes 120 for receiving shoe laces.

The tongue 112 of the upper 100 extends from the central region 110 of the upper 100 for a portion of the length 102 of the upper 100. The tongue 112 may also include a plurality of slits or holes 120 for receiving shoe laces. The gusset 114 of the upper 100 extends from the tongue 112 to the second end 107 of the upper 100. In one embodiment, when the upper 100 is folded, the gusset 114 may extend underneath a portion of the toe region 108 and/or central region 110.

Figure 2:
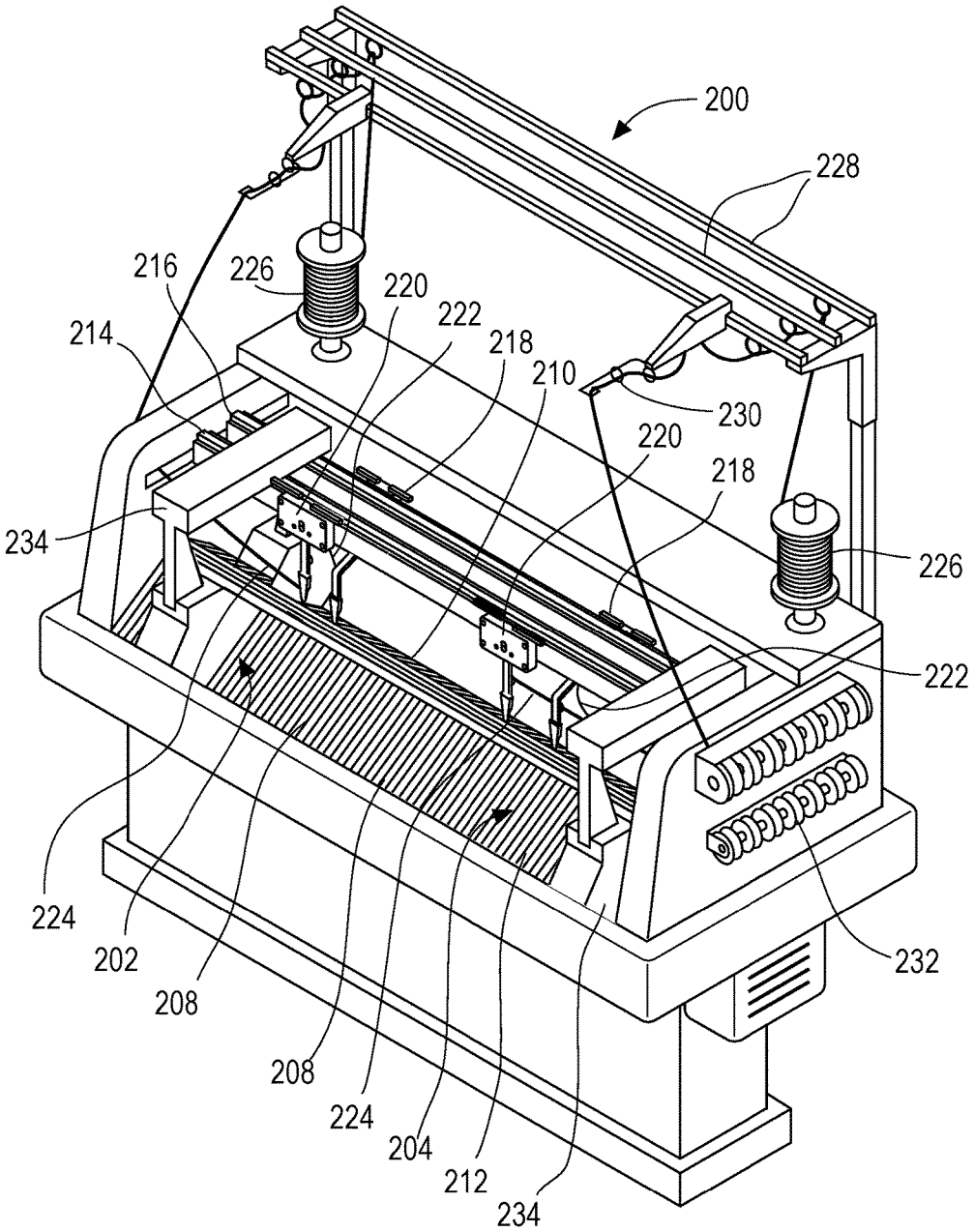
FIG. 2 shows a perspective view of an embodiment of a knitting machine knitting two of the pre-folded uppers of FIG. 1.
Figure 3:
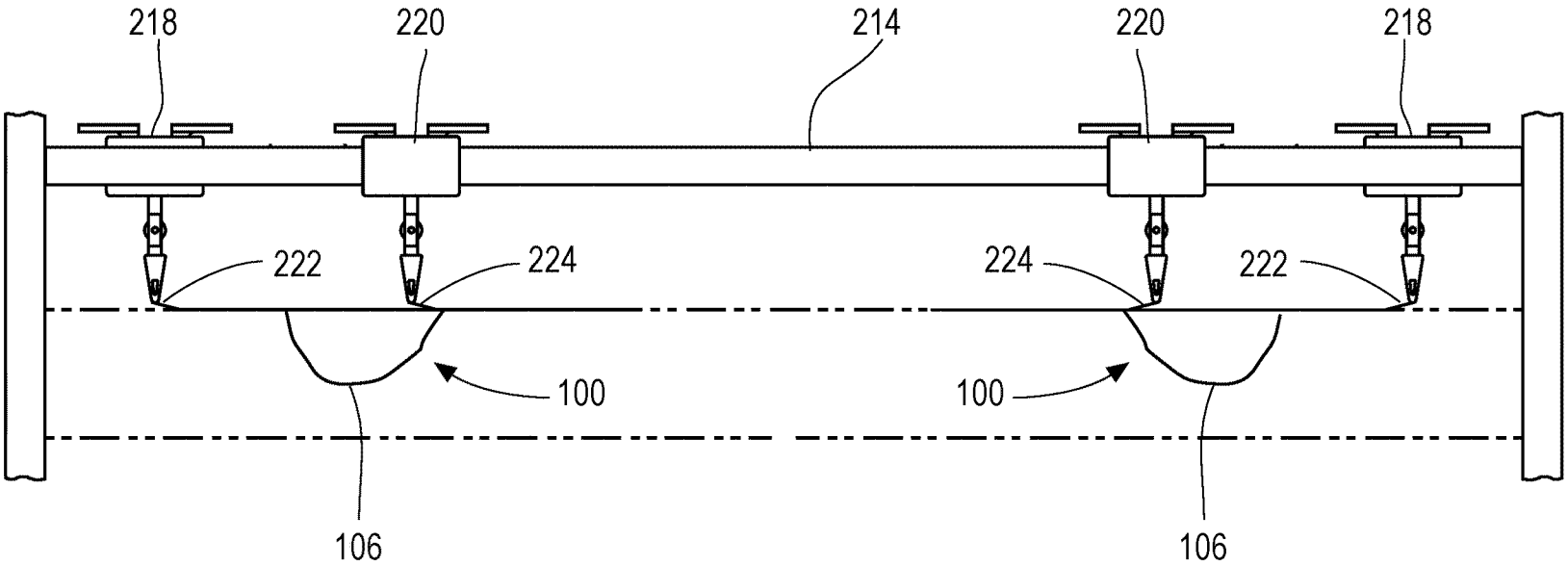
FIG. 3 shows a front view of the knitting machine of FIG. 2 knitting two of the pre-folded uppers of FIG. 1.
Figure 4:
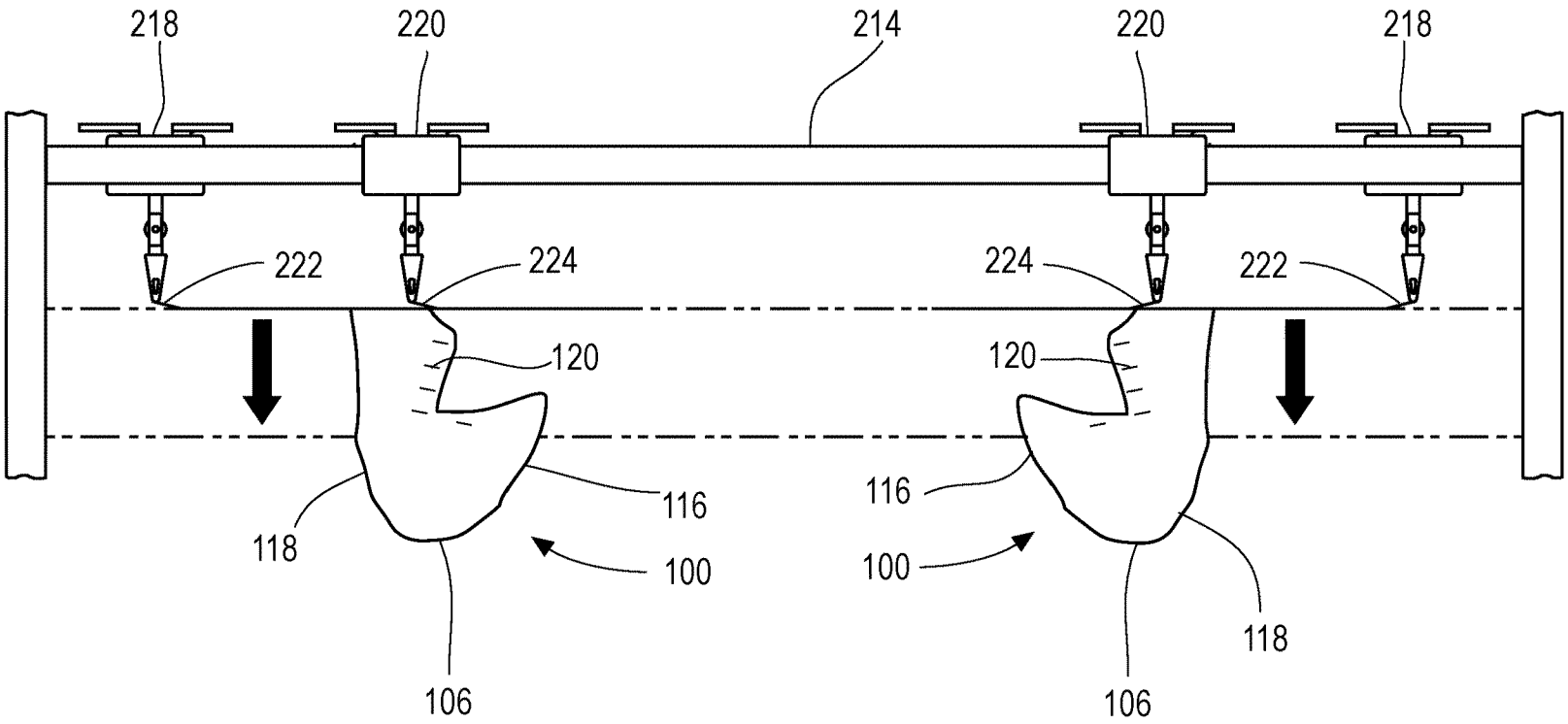
FIG. 4 shows another front view of the knitting machine of FIG. 2 knitting two of the pre-folded uppers of FIG. 1.
Figure 5:
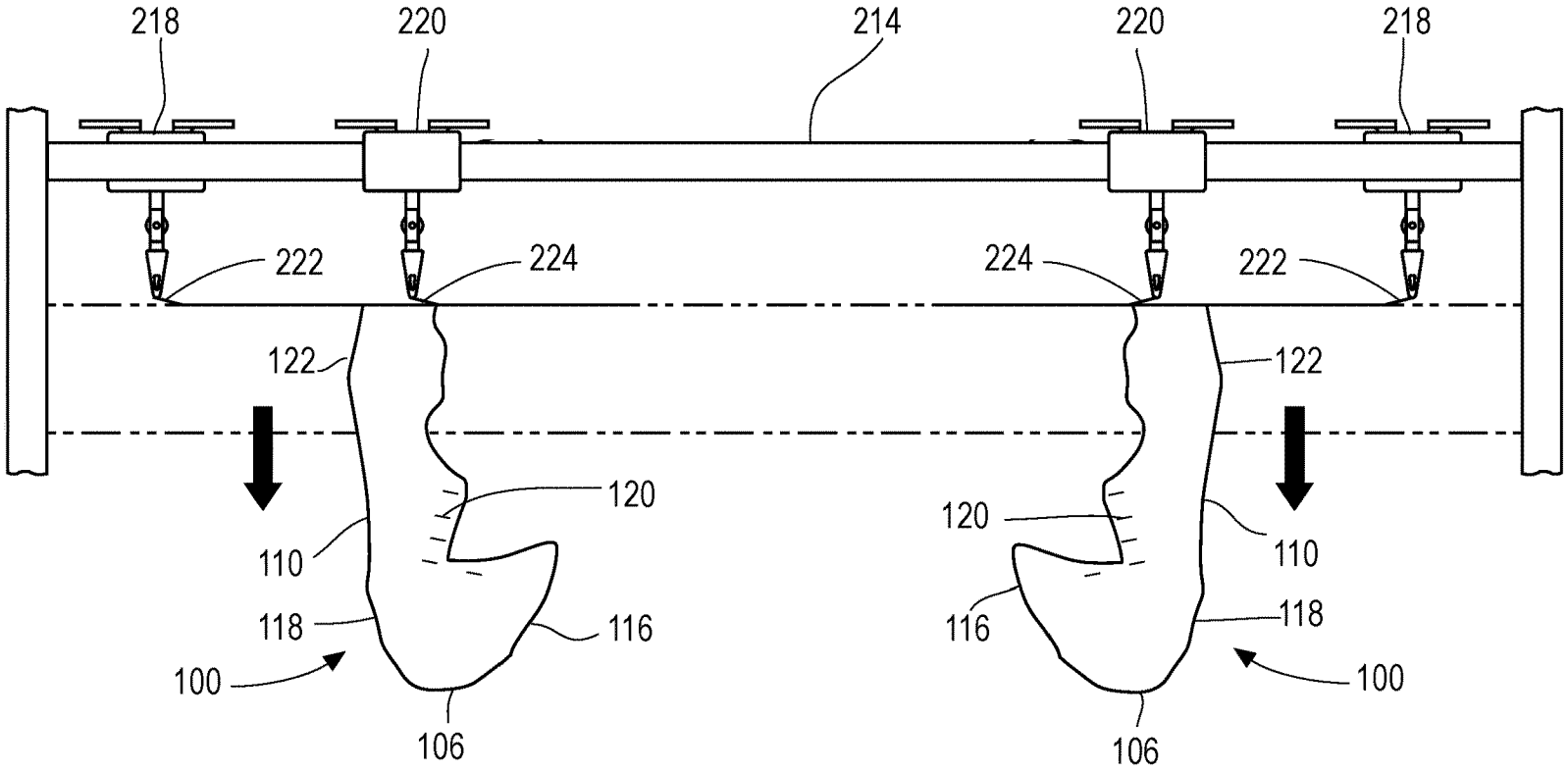
FIG. 5 shows another front view of the knitting machine of FIG. 2 knitting two of the pre-folded uppers of FIG. 1.
Figure 6:
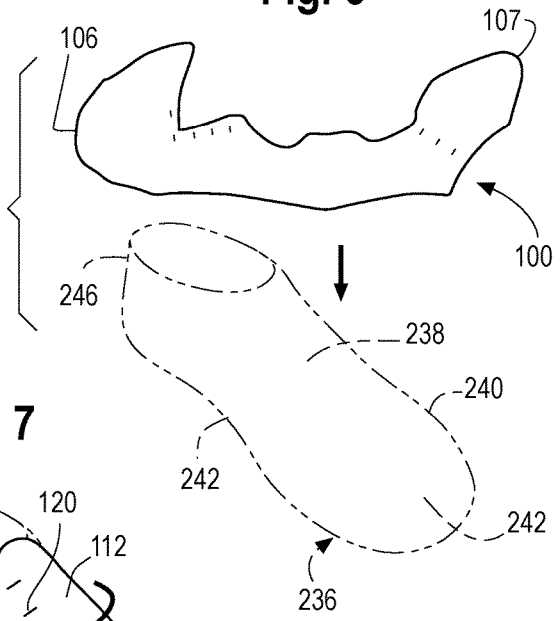
FIG. 6 shows a perspective view of the upper of FIG. 1 in a pre-folded shape.

The upper 100 may be manufactured using a textile manufacturing machine. FIG. 2 shows an embodiment of a textile manufacturing machine 200 as a flat knitting machine. Knitting machine 200 includes a first section 202 and a second section 204. One of the first and second sections 202, 204 may knit the left or right upper, while the other of the first and second sections 202, 204 may knit the other of the left or right upper. Alternatively, the first and second sections 202, 204 may knit two right uppers and then subsequently knit two left uppers and vice versa. As shown in FIGS. 3-5, a right upper is being knitted within the first section 202 and the left upper 100 is being knitted within the second section 204.

The knitting machine 200 may be programmed such that the carriages and/or feeders of one section do not extend into the other section. The knitting machine 200 may also be programmed such that the needles in the middle portion of the row of needle beds 208, 210, i.e. the portion between the first and second sections 202 204, are locked, deactivated, or not programmed for use such that no knitting occurs in the middle portion and knitting only occurs in the first and second sections 202, 204. In an alternative configuration, the knitting machine 200 may include a separation element between the first section 202 and the second section 204 to provide a physical barrier between the first section 202 and the second section 204. The separation element may prevent the carriages and/or feeders of one section, described in detail below, from extending into the other section.

Each section 202, 204 of the knitting machine 200 includes two needle beds 208, 210. The needle beds 208, 210 are angled with respect to each other to form a V shape, also known as a V-bed flat knitting machine. Each of the needle beds 208, 210 include a plurality of needles 212. In one position, as shown in FIG. 2, the needles 212 of the needle beds 208, 210 maintain the V-shape. In another position, the needles 212 may travel up the needle beds 208, 210 such that the needles 212 of one needle bed 208 and the needles 212 of the other needle bed 210 will pass next to one another and intersect to form an X shape. As shown in FIG. 2, the needle bed 208 extends continuously in a row from the first section 202 to the second section 204, and the needle bed 210 also extends continuously in a row from the first section 202 to the second section 204. If the knitted machine 200 includes a separation element between the first and second sections 202, 204, as described previously, then the needle bed 208 of the first section 202 would be separated from the needle bed 208 of the second section 204 by the separation element, and the needle bed 210 of the first section 202 would also be separated from the needle bed 210 of the second section 204 by the separation element.

The knitting machine 220 may include two rails 214, 216. The rails 214, 216 are positioned above the needle beds 208, 210. The rails 214, 216 provide attachment points for standard feeders 218 and combination feeders 220. If the knitting machine 200 includes the separation element between the first and second sections 202, 204, as described previously, then each section 202, 204 of the knitting machine 200 may each include two rails 214, 216. Each rail 214, 216 includes two sides. One side may be for attachment of standard feeders 218 and the other side may be for attachment of combination feeders 220. FIG. 2 shows one standard feeder 218 and one combination feeder 220 for each section 202, 204; however, any number and/or configuration of standard feeders 218 and/or combinations feeders 220 on the rails 214, 216 may be used on the knitting machine 200. Although FIG. 2 shows two rails 214, 216, knitting machine 200 may also include additional rails to provide attachment points for more feeders 218, 220.

The feeders 218, 220 supply yarn or other materials, such as a filament, thread, rope, webbing, cable, chain or other component, to the needles 212 to manufacture and knit the uppers 100. The standard feeders 218 supply yarn 222 to the needles 212, and the needles 212 knit, tuck, and/or float the yarn 222. The combination feeders 220 also may supply yarn 224 to the needles 212 to knit, tuck, and/or float the yarn 224, and the combination feeders 220 may also inlay yarn 224. Also, combination feeder 220 may be used to supply or inlay any strand in addition to yarn, such as filament, thread, rope, webbing, cable, chain, or other strands. In addition to combination feeders 220, a conventional inlay feeder may also be provided and used to inlay yarn. Each standard feeder 218 and combination feeder 220 includes one attachment point for one of the rails 214, 216. By comparison, a conventional inlay feeder includes two attachment points for one of the rails 214, 216.

The knitting machine 200 includes a plurality of spools 226 that supply yarn to the feeders. FIG. 2 shows spools 226 supplying yarn 224 to the combination feeders 220. Yarn 224 extends from spool 226 to one of a plurality of yarn guides 228, to a yarn take-back spring 230, to a yarn tensioner 232, and then to the feeder 220. Additional spools (not shown) may be used to provide yarns to standard feeders 218 in a similar manner as spools 226.

The yarn 222 used for the standard feeders 218 may be the same or different than the yarn 224 used for the combination feeders 220. Also, additional spools may be provided to provide different yarns to the standard feeders 218 and to the combination feeders 220. For example, one type of yarn may be used to knit the toe region 108 of the upper 100, and another type of yarn may be used to knit the central region 110 of the upper 100. Different types of yarn may also be used to form various patterns within upper 100. The combination feeders 220 may also be used to inlay yarn or other strands, such as filament, thread, rope, webbing, cable, chain or other strands to one of the regions of the upper 100.

The feeders 218, 220 travel along the rails 214, 216 via a carriage 234 to supply yarn to the needles 212. Each section 202, 204 of the knitting machine 200 may include one carriage 234 for the corresponding feeders 218, 220 of each section 202, 204.

FIGS. 3-5 show a left upper and a right upper 100 being knitted off the knitting machine 200 at the same time, or at least a partially overlapping time, in the pre-folded shape, which is a two-dimensional (2D) shape. Although FIGS. 3-5 show the left and right uppers 100 being knitted off the knitting machine 200 in a two-dimensional (2D) shape, in alternative embodiments, the left and right uppers 100 may include portions, such as the toe region 108, the central region 110, the tongue 112, the gusset 114, the heel region 122, and/or other portions, that have three-dimensional (3D) curvature when knitted off the knitting machine 200 to reduce post-knitting folding steps of the uppers 100. The knitting machine 200 forms the upper 100 by using yarn to form a plurality of intermeshed loops that define horizontal courses, which are formed generally parallel to the direction of the rails 214, 216, and vertical wales, which are formed generally perpendicular to the direction of the rails 214, 216, of a knitted textile. As previously discussed, the knitting machine 200 may be programmed such that the feeders 218, 220 and carriage 234 within each section 202, 204 remain within each respective section and do not travel along the entire length of either the rail 214 or the rail 216. As described previously, the middle portion of the row of needle beds 208, 210 may also be programmed to lock or deactivate such that no knitting occurs in the middle portion and knitting only occurs in the first and second sections 202, 204. In an alternative embodiment, when the knitting machine 200 includes a separation element, the separation element provides a physical barrier to prevent the feeders 218, 220 and the carriage 234 in one section from traveling to another section.

To knit each course, the feeders 218, 220 may only travel the distance along the rails 214, 216 within their respective section 202, 204 to supply yarn to the needles 212 within each respective section 202, 204. Therefore, to knit each upper 100, the feeders 218, 220 do not need to travel along the entire length of each rail 214 or 216 in both sections 202, 204 to supply yarn to the needles 212 to knit the upper 100. This shorter travel distance allows the feeders 218, 220 to supply yarn to the needles 212 faster and, in turn, knit the upper 100 at a faster rate.

With the shorter travel distance available for the feeders 218, 220, each upper 100 is knitted along the width of each region of the upper 100 in its pre-folded shape. In other words, the length of each rail 214, 216 used in section 202 or section 204, as well as each needle beds 208, 210 used, may be smaller than the length 102 of each upper 100. Therefore, as shown in FIGS. 3-5, the right and left upper 100 are knitted such that each upper 100 is knitted off the knitting machine 200 with the length 102 of each upper 100 being perpendicular to the direction of the rails 214, 216 and the width 104 of each upper 100 being parallel to the direction of the rails 214, 216.

The knitting of two uppers 100 at the same time or at least a partially overlapping time on the same knitting machine increases the production efficiency of a pair of uppers for shoes. Production efficiency is increased by decreasing the amount of time it takes to knit one or more uppers, including a pair of uppers for a left foot and a right foot of a wearer, on the same knitting machine.

Once the knitting is complete, the uppers 100 may be steamed or treated to help stretch and mold or otherwise form the upper 100 into its folded shape. FIGS. 6-9 show the upper 100, in this embodiment the left upper, being folded around a mold 236. The shape of the mold 236 corresponds with the shape of either a left foot or a right foot and provides a three-dimensional (3D) shape to help stretch and mold the two-dimensional (2D) upper 100 into its folded three-dimensional (3D) shape. As described previously, portions of the upper 100 may already include a 3D shape or curvature after being knitted off the knitting machine 200 and before the folding of the upper 100. The shape of the mold 236 shown in FIGS. 6-9 corresponds to the shape of a left foot. It will be appreciated that a mold 236 for a right foot may be used to stretch and mold an upper 100 for a right foot, and FIGS. 6-9 are shown for illustrative purposes. The steps shown in FIGS. 6-9 are an exemplary embodiment for forming the upper 100 into a three-dimensional (3D) shape. In alternative embodiments, the positioning of the upper 100 on the mold 236 may be adjusted as necessary to accommodate different sizes and shapes.

Figure 7:
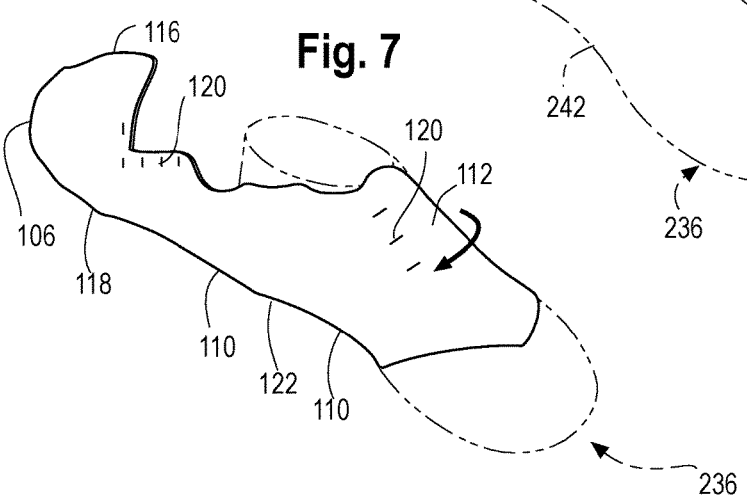
FIG. 7 shows a perspective view of the upper of FIG. 1 being folded to conform to the shape of a foot.

Beginning with FIG. 7, the second end 107 of the upper 100 may be positioned on the lateral side 240 of the mold 236. The gusset 114 of the upper 100 then extends from the lateral side 240 of the mold 236 toward the instep 238 of the mold 236, and the tongue 112 of the upper 100 extends over the instep 238 of the mold 236. The central region 110 of the upper 100 then extends from the instep 238 of the mold 236 along the medial side 242 of the mold 236 toward the heel region 246 of the mold 236.

Figure 8:
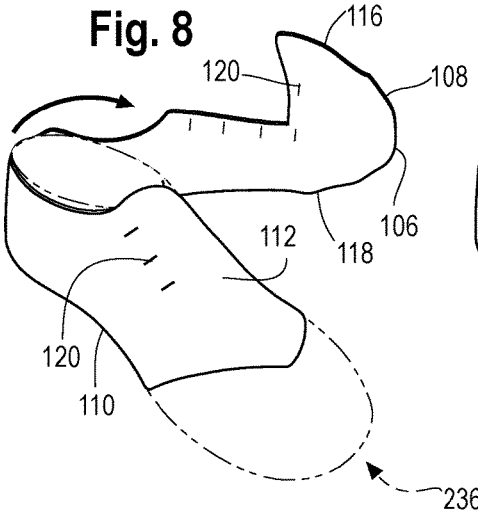
FIG. 8 shows another perspective view of the upper of FIG. 1 being folded to conform to the shape of a foot.

The heel region 122 of the central region 110 of the upper 100 then extends around the heel region 246 of the mold 236 as shown in FIG. 8, and the central region 110 of the upper 100 extends from the heel region 246 of the mold 236 along the lateral side 240 of the mold 236. When the central region 110 of the upper 100 extends along the lateral side 240 of the mold 236, the central region 110 extends over the gusset 114 of the upper 100.

Figure 9:
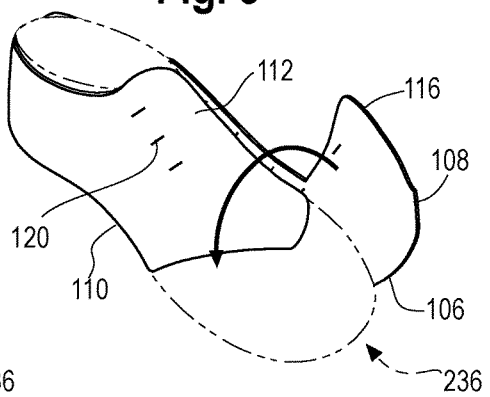
FIG. 9 shows another perspective view of the upper of FIG. 1 being folded to conform to the shape of a foot.

As shown in FIG. 9, after positioning the central region 110 of the upper along the lateral side 240 of the mold 236, the toe region 108 of the upper 100 extends from the lateral side 240 of the mold 236 across the toe region 242 of the mold 236. The plurality of slits 120 adjacent to the tongue 112 and the plurality of slits 120 adjacent to toe region 108 are now positioned parallel to one another on either side of the tongue 112 of the upper 100. FIG. 10 shows the upper 100, in this embodiment the left upper, in its folded three-dimensional (3D) shape, and FIG. 11 shows a pair of uppers 100 in their folded three-dimensional (3D) shape.

After the upper 100 is molded or otherwise folded into its three-dimensional (3D) folded shape, the portions of the upper 100 that overlap in the folded shape, including, for example, where the central region 110 overlaps the gusset 114, may be stitched, knitted, melted, adhesively connected, or otherwise secured to each other to maintain the upper 100 in its three-dimensional (3D) folded shape.

Different elements may be added to upper 100 to form a shoe including a sole 244, as shown in FIG. 11. Shoelaces may be used and positioned through the plurality of slits 120 to tighten the upper 100 to the foot of the wearer. A strobel may also be positioned over the sole 244 to provide cushion or support to the sole of the foot of the wearer.

Figure 12:
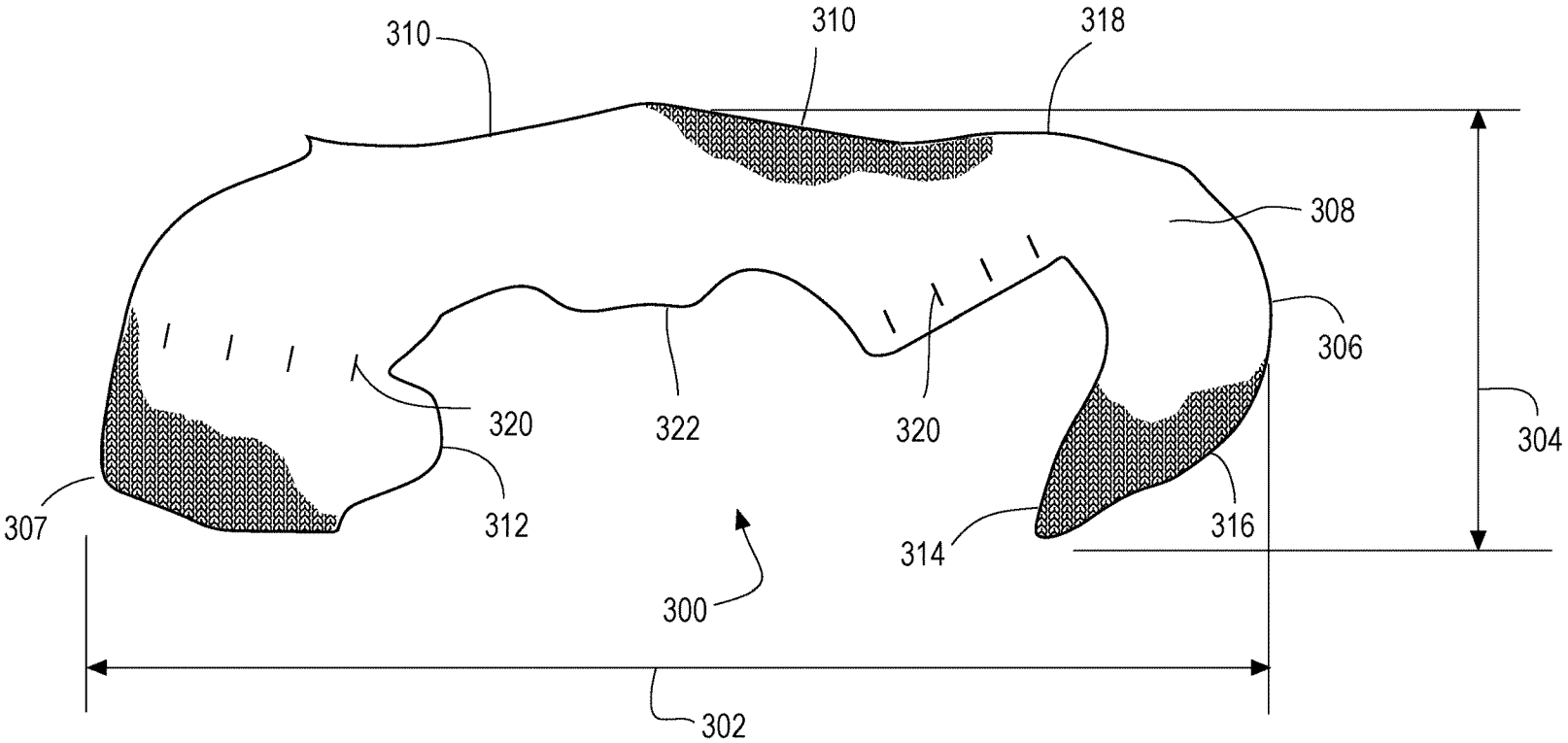
FIG. 12 shows a top view of a second embodiment of an upper in a pre-folded shape.

FIG. 12 shows a second embodiment of an upper 300 for an article of footwear in a pre-folded shape. The upper 300 may be for a left upper or a right upper. FIG. 12 will be described as showing a left upper and such description is for aiding discussion and it is contemplated that the upper 300 shown in FIG. 12 may also be configured for a right upper. The right upper may be symmetrical to the left upper except it is flipped along its width.

The upper 300 includes a length 302 and a width 304. The length 302 of the upper 300 extends from a first end 306 to a second end 307 of the upper 300. The width 304 of the upper 100 is the maximum width of the upper 300 along its length 302. In various desirable embodiments, the length 302 of the upper 300 may be at least two times greater than the width 304 of the upper 300.

The pre-folded upper 300 also includes a toe region 308, a central region 310, a tongue 312, and a gusset 314. The toe region 308 extends from the first end 306 of the upper 300 for a length along a medial side 316 of the toe region 308 and for a length along a lateral side 318 of the toe region 308. The gusset 314 of the upper 300 extends from the toe region 308 for a portion of the length 302 of the upper 300. In one embodiment, when the upper 300 is folded, the gusset 314 will extend over a portion of the central region 110 adjacent to the tongue 312. The dimensions of the upper 300 and each respective side and/or region of the upper 100 will vary depending on the size of the foot of the wearer for the upper 300.

The central region 310 of the upper 300 extends from the toe region 308 for a portion of the length 302 of the upper 300. The central region 310 includes a heel region 322 that, when folded, is configured to extend around the heel of a wearer. When the upper 300 is folded, similar to the upper 100, a portion of the central region 310 of the upper 300 will extend along the medial side 316 of the upper 300 and a portion of the central region 310 will also extend along the lateral side 318 of the upper 300. The central region 310 and/or the toe region 308 may include a plurality of slits or holes 320 for receiving shoe laces.

The tongue 312 of the upper 300 extends from the central region 310 of the upper 300 for a portion of the length 302 of the upper 300. The tongue 312 may also include a plurality of slits or holes 320 for receiving shoe laces.

A pair of uppers 300 may be manufactured using the knitting machine 200 and the process described previously to manufacture upper 100. The upper 300 may also be treated or processed and then folded using the process described previously to fold upper 100 into a three-dimensional (3D) shape. As described previously regarding upper 100, portions of the upper 300 may already include a 3D shape or curvature after being knitted off the knitting machine 200 and before the folding of the upper 300. However, in this embodiment, with the gusset 314 adjacent to the toe region 308 of the upper 300 in the pre-folded shape, when the upper 300 is folded, the gusset 314 will extend over a portion of the central region 310 adjacent to the tongue 312 of the upper 300.

After the upper 300 is molded or otherwise folded into its three-dimensional (3D) folded shape, the portions of the upper 300 that overlap in the folded shape, including, for example, where the gusset 314 overlaps a portion of the central region 310, may be stitched, knitted, melted, adhesively connected, or otherwise secured to each other to maintain the upper 300 in its three-dimensional (3D) folded shape.

Advantageously, the present embodiments increase the production efficiency of knitting machines by knitting a pair of uppers for an intended wearer at the same time, or at least a partially overlapping time, off the same knitting machine. For example, the knitting time for a pair of uppers is decreased, which decreases machine usage and related expenses, including power and wear on the machine. The increased production allows for faster production of uppers and therefore more uppers produced within a period of time.

As another advantage, the present embodiments reduce the distance that the carriage and feeders need to travel across the needle bed to manufacture the upper. The decreased travel distance for the carriage and associated feeders also increases the production efficiency of the knitting machines. For example, rather than having to travel across the needle bed for a distance that is the length of an upper to knit a course in the upper and then having to travel back across the needle bed the same distance to knit a subsequent course in the upper, the travel distance for the carriage and associated feeders is decreased to smaller than the length of the upper.

As yet a further advantage, the present embodiments allow for an efficient way for customization of shoes. For example, a customer may order a customized pair of shoes that may include, without limitation, different yarn colors or different types of yarn that the customer will choose for the shoes. With a customized pair of shoes, the left and right uppers may include the same pattern of yarns or the left upper may include a different pattern of yarns than the right upper and vice versa. The present embodiments allow for a customized order of a pair of shoes to be completed in a decreased amount of time, which allows for faster and increased production and sale of customized shoes for customers.

It will be appreciated by those skilled in the art that changes could be made to the embodiments described above without departing from the broad inventive concept therefore. It is understood, therefore, that this invention is not limited to the particular embodiments disclosed, but it is intended to cover modifications within the spirit and scope of the present invention as defined by the claims.

The invention claimed is:

1. A method for manufacturing articles of footwear, the method comprising:

forming a first upper on a textile manufacturing machine; and forming a second upper on the textile manufacturing machine at a time that at least partially overlaps with formation of the first upper;

wherein the first upper and the second upper are formed at separate locations of the textile manufacturing machine such that the first and second uppers are disconnected from each other;

wherein the textile manufacturing machine comprises a first section and a second section, the first upper being formed in the first section, and the second upper being formed in the second section;

wherein the textile manufacturing machine comprises one or more inactivated needles that separate the first section from the second section;

wherein the first section comprises one or more first feeders, and the second section comprises one or more second feeders; and wherein the one or more first feeders remain within the first section, and the one or more second feeders remain within the second section.

2. The method of claim 1, wherein the first upper is formed using a first set of needles of the textile manufacturing machine, wherein the second upper is formed using a second set of needles of the textile manufacturing machine, and wherein the first set of needles is separated from the second set of needles.

3. The method of claim 1, wherein the textile manufacturing machine forms a pre-folded shape of the first and second uppers, and wherein at least one subsequent folding step forms a final shape of the first and second uppers.

4. The method of claim 1, wherein the first upper is associated with one of a right or left shoe, and the second upper is associated with the other of the right or left shoe, such that uppers for one pair of shoes are formed at the at least partially overlapping time.

5. The method of claim 1, wherein the first upper is formed using material provided by the one or more first feeders, wherein the second upper is formed using material provided by the one or more second feeders, wherein the one or more first feeders does not provide material for formation of the second upper, and the one or more second feeders does not provide material for formation of the first upper.

6. The method of claim 1, wherein the first upper comprises first and second ends along a length of the upper in a pre-folded shape, wherein the first end comprises a toe region, and a central region disposed between the first and second ends comprises a heel region.

7. The method of claim 1, wherein the first upper is formed on the textile manufacturing machine in a configuration having a length and a width, wherein the length is at least two times greater than the width.

8. A method for manufacturing articles of footwear, the method comprising:

forming a first upper on a textile manufacturing machine; and forming a second upper on the textile manufacturing machine at a time that at least partially overlaps with formation of the first upper, wherein the first upper is formed on the textile manufacturing machine in a configuration having a length and a width, wherein the length is at least two times greater than the width such that the first and second uppers are disconnected from each other;

wherein the textile manufacturing machine comprises a first section and a second section, the first upper being formed in the first section, and the second upper being formed in the second section;

wherein the first section comprises a standard feeder and a combination feeder, and the second section comprises a standard feeder and a combination feeder; and wherein the standard feeder and combination feeder in the first section remain within the first section, and the standard feeder and combination feeder in the second section remain within the second section.

9. The method of claim 8, further comprising the first upper and the second upper at separate locations of the textile manufacturing machine.

10. The method of claim 9, wherein the first upper is formed using a first set of needles of the textile manufacturing machine, wherein the second upper is formed using a second set of needles of the textile manufacturing machine, and wherein the first set of needles is separated from the second set of needles.

11. The method of claim 8, wherein the textile manufacturing machine forms a pre-folded shape of the first and second uppers, and wherein at least one subsequent folding step forms a final shape of the first and second uppers.

12. The method of claim 8, wherein the first upper is associated with one of a right or left shoe, and the second upper is associated with the other of the right or left shoe, such that uppers for one pair of shoes are formed at the at least partially overlapping time.

13. The method of claim 8, wherein the first upper is formed using material provided by the one or more first feeders, wherein the second upper is formed using material provided by the one or more second feeders, wherein the one or more first feeders do not provide material for formation of the second upper, and the one or more second feeders do not provide material for formation of the first upper.

14. The method of claim 8, wherein the first upper comprises first and second ends along the length of the upper in the pre-folded shape, wherein the first end comprises a toe region, and a central region disposed between the first and second ends comprises a heel region.

* * * * *